US005499081A

United States Patent [19]

Mizude et al.

[11] Patent Number: 5,499,081

[45] Date of Patent: Mar. 12, 1996

[54] HIGH SPEED IMAGE FORMING APPARATUS

[75] Inventors: Kazuhiro Mizude; Hideki Ishida; Hisahiro Kato; Tomohiro Tsutano, all of Osaka, Japan

[73] Assignee: Mita Industrial Co., Ltd., Osaka, Japan

[21] Appl. No.: 294,524

[22] Filed: Aug. 23, 1994

[30] Foreign Application Priority Data

Aug. 25, 1993 [JP] Japan ..... 5-210723

[51] Int. Cl.[6] ..... G03G 21/00; G03G 15/045

[52] U.S. Cl. ..... 355/208; 355/210; 355/219

[58] Field of Search ..... 355/210, 211, 355/212, 213, 219, 203, 204, 208, 200

[56] References Cited

U.S. PATENT DOCUMENTS 4,621,920 11/1986 Takahashi ..... 355/210
5,043,864 8/1991 Inuzuka et al. ..... 355/204 X
5,325,155 6/1994 Perry ..... 355/208
5,339,136 8/1994 Parsons et al. ..... 355/208
5,369,473 11/1994 Ogawa et al. ..... 355/208 X

FOREIGN PATENT DOCUMENTS 0135848 6/1987 Japan .

*Primary Examiner*—Matthew S. Smith
*Attorney, Agent, or Firm*—Jordan and Hamburg

[57] ABSTRACT

An image forming apparatus includes a photosensitive drum driver for rotating a photosensitive drum at either a normal speed or a higher speed, a charger, a charge remover for removing residual charges on the photosensitive drum surface after a toner image is transferred, a starter for instructing a start of image forming operation, and a controller responsive to the starter for controlling the operative parts. Upon the starter being turned on, the controller drives the charger and the charge remover, and permits the photosensitive drum driver to rotate the photosensitive drum at the higher speed, and suspends the image formation, After the photosensitive drum completes the initial one turn, the controller starts the image formation and permits the photosensitive drum driver to rotate the photosensitive drum at the normal speed.

8 Claims, 5 Drawing Sheets

HIGH SPEED IMAGE FORMING APPARATUS

BACKGROUND OF THE INVENTION

This invention relates to image forming apparatus, such as a copying machine, capable of performing image forming operation at a high speed.

With such high speed image forming apparatus, upon a start key being depressed, a photosensitive drum is rotated and simultaneously charged at a specified level by a main charger. A light image reflected from an original document is introduced to a charged surface of the photosensitive drum to form an electrostatic latent image on the surface of the photosensitive drum. To attain high speed image forming operation, the light image is introduced to the charged surface immediately after the charging of the photosensitive drum is started. In other words, the latent image formation is started before the photosensitive drum completes the initial turn.

The latent image is developed into a toner image by electrically attracting toner particles from a developing device. The toner image is transferred by a transfer device from the photosensitive drum surface to a copy sheet which is transported from a cassette into a space between the photosensitive drum surface and the transfer device.

Residual toner is removed by a cleaning device from the surface of the photosensitive drum by a cleaning device after the toner image transfer is completed, and residual charges are removed from the photosensitive drum surface by a removal lamp. Thereafter, the photosensitive drum is again charged at the specified potential level to execute another image forming operation.

However, the residual electric charges on the surface of the photosensitive drum cannot be completely removed even if the luminance and illuminating time of the removal lamp are increased. As shown in FIG. 5, if the photosensitive drum surface which has been charged at V1, e.g., 700 to 800 V, in the initial stage is removed by a removal lamp, there is left a residual potential V2, e.g., 20 to 30 V, on the photosensitive drum surface.

Consequently, such residual potential of the initial charging increases the dark potential of the photosensitive drum surface for the second and following chargings. In other words, there occurs a potential difference between an initial charging portion and a second charging portion (i.e., once charged portion) on the photosensitive drum surface. If an electrostatic latent image and toner image are formed over both the initial charging portion and the second charging portion, the image density of the initial charging portion will become considerably different from that of the second charging portion to display two different portions in tone. This difference is most noticeable in a half-tone image.

SUMMARY OF THE INVENTION

It is an object of the present invention to provide high speed image forming apparatus which has overcome the above problems residing in the prior art.

It is another object of the present invention to provide a high speed image forming apparatus which can produce a copy image having a uniform tone even if the copy image is produced over initial and second charging portions.

Accordingly, the present invention is directed to an image forming apparatus comprising: a photosensitive drum rotatable in a specified direction; a photosensitive drum driver for rotating the photosensitive drum at either a first speed or a second speed faster than the first speed; a charger for charging the photosensitive drum; an image formation portion including: a light image projector for projecting a light image onto a charged surface of the photosensitive drum to form an electrostatic latent image; a developer for developing the electrostatic latent image into a toner image; and a transfer for transferring the toner image onto copy paper; a charge remover for removing residual charges on the photosensitive drum surface after the toner image is transferred; a starter for instructing a start of image forming operation; and a controller responsive to the starter for, upon the starter being turned on, driving the charger and the charge remover, permitting the photosensitive drum driver to rotate the photosensitive drum at the second speed, and suspending the image formation portion; and after the photosensitive drum completing the initial one turn, driving the image formation portion together with the charger and the charge remover, and permitting the photosensitive drum driver to rotate the photosensitive drum at the first speed.

The controller may be provided with detector means for detecting the completion of the initial turn of the photosensitive drum. The detector means may be constructed by a memory for storing a time necessary for the photosensitive drum to make one turn at the second speed; and a timer for detecting the lapse of the time. Also, the detector means may be constructed by a mark attached at a specified position of the photosensitive drum; and a sensor for sensing the mark to detect one turn of the photosensitive drum.

Further, the photosensitive drum driver may be constructed by a motor for driving the photosensitive drum; and a driving circuit in connection with the controller for sending a wide width pulse drive signal to the motor to rotate the photosensitive drum at the second speed or a narrow width pulse drive signal to the motor to rotate the photosensitive drum at the first speed.

With thus constructed image forming apparatus, an initial image formation is suspended until the photosensitive drum completes the initial turn of the photosensitive drum. Further, the photosensitive drum is rotated at the second speed or higher speed in the initial turn. The photosensitive drum is prevented from being formed with a potential difference which is otherwise to be defined by an initial charging area and a second charging area. Also, since the photosensitive drum is rotated at the high speed before the image formation is started, the initial charging and removing can be performed for a shortened period of time. Accordingly, the image forming apparatus can produce an initial copy image without accompanying the tone difference for a shorter time.

Also, detection of the completion of the initial turn of the photosensitive drum is carried out based on the measurement of the time necessary for the photosensitive drum to make one turn at the second speed, or based on the sensing of the mark attached at a specified position of the photosensitive drum. Accordingly, the initial turn detection can be assuredly accomplished in a simple construction.

The rotation speed of the photosensitive drum is controlled by a width modulated pulse signal. Accordingly, the speed change of the drum can be carried out more promptly and accurately.

The above and other objects, features and advantages of the present invention will become more apparent upon a reading of the following detailed description and drawings.

BRIEF DESCRIPTION OF THE DRAWINGS

FIG. 4 is a waveform diagram showing operation states of related parts of the copying machine after a start key is turned on.

DETAILED DESCRIPTION OF THE PREFERRED EMBODIMENTS OF THE INVENTION

Figure 1:
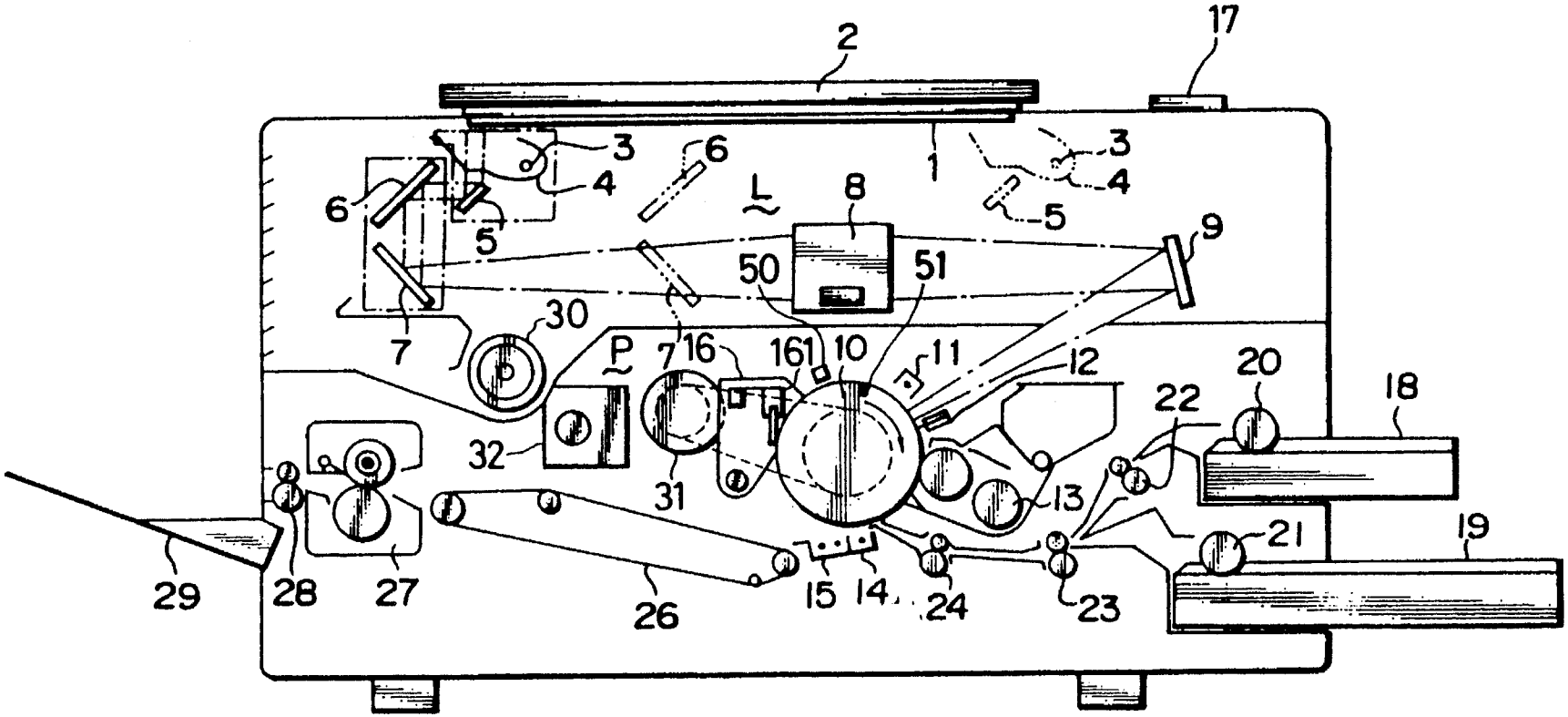
FIG. 1 is a schematic diagram showing an overall construction of a high speed copying machine embodying the present invention.

A high speed copying machine according to the invention will be described with reference to the accompanying drawings. FIG. 1 is a diagram schematically showing an overall construction of the copying machine.

The copying machine is provided with a contact glass 1, a document presser 2 above the contact glass 1, and a function key portion 17 on an upper portion thereof, and an optical assembly L, an imaging assembly P, and a sheet transport assembly in an inside portion thereof.

The optical assembly L includes an exposure lamp 3, a reflector 4, a light source for illuminating a document placed on the contact glass 1 while reciprocally moving in sidewise directions of the copying machine, reflecting mirrors 5, 6, 7 for reflecting a light image along a specified optical path, a lens unit 8 for adjusting the magnification of the light image, and a fixed mirror 9 for directing the light image to a photosensitive drum 10.

The imaging assembly P includes the photosensitive drum 10, a main charger 11, a blank lamp 12, a developing device 13, a transferring device 14, a separating device 15, and a cleaner 16. The photosensitive drum 10 is adapted for bearing an electrostatic latent image and a toner image on a surface thereof. The main charger 11 positively charges the photosensitive drum 10 at a specified potential level. The blank lamp 12 is adapted for removing electric charges from an unnecessary charged area of the photosensitive drum surface.

The developing device 13 stores negatively charged toner particles. Charged toner particles are electrically attracted to the electrostatic latent image on the photosensitive drum surface to thereby develop the latent image into a toner image.

The transferring device 14 has a charger which is driven by a direct current, and positively charges a copy sheet to transfer the toner image onto a copy sheet. The separating device 15 has a charger which is driven by an alternating current, and electrically separates the copy sheet bearing the toner image from the surface of the photosensitive drum 10.

The cleaner 16 removes residual toner particles from the surface of the photosensitive drum 10 after the image transfer is finished. The cleaner 16 includes a charge removal lamp 161 for removing residual charges from the surface of the photosensitive drum 10 to allow the photosensitive drum 10 to be charged freshly by the main charger 11 for another image formation.

The sheet transport assembly includes cassettes 18, 19 for containing stacks of copy sheets of different sizes, respectively, feed rollers 20, 21 for taking out the copy sheets one by one from the cassettes 18, 19, transport roller pairs 22, 23, and a pair of registration rollers 24 arranged along a direction of transport of copy sheet in this order. The sheet transport assembly further includes on a downstream side from the photosensitive drum 10 a transport belt 26 for transporting the copy sheet bearing the toner image further downstream, a fixing device 27 for fixing the toner image on the copy sheet, and a pair of discharge rollers 28 for discharging the copy sheet bearing the fixed copy image to a discharge tray 29.

Further, there are provided an optical assembly drive motor 30, photosensitive drum drive motor 31, and main drive motor 32. The optical assembly drive motor 30 is adapted for moving the light source and the reflecting mirrors 5, 6, 7 reciprocally in the sidewise directions.

The photosensitive drum drive motor 31 is adapted for rotating the photosensitive drum 10 in a specified direction. The photosensitive drum drive motor 31 rotates the photosensitive drum 10 either at a first speed S1 on a second speed S2 faster than the first speed S1 in accordance with a control signal from a controller as will be described later. The first speed S1 is adapted for performing the normal copying operation. The second speed S2 is adapted for rotating the photosensitive drum 10 in an initial stage. The photosensitive drum drive motor 31 is driven by a direct current.

The main motor 32 is adapted for driving the other portions than the optical assembly L and the photosensitive drum 10, e.g., the transport rollers including the registration roller pair 24 and the fixing device 27.

Figure 2:
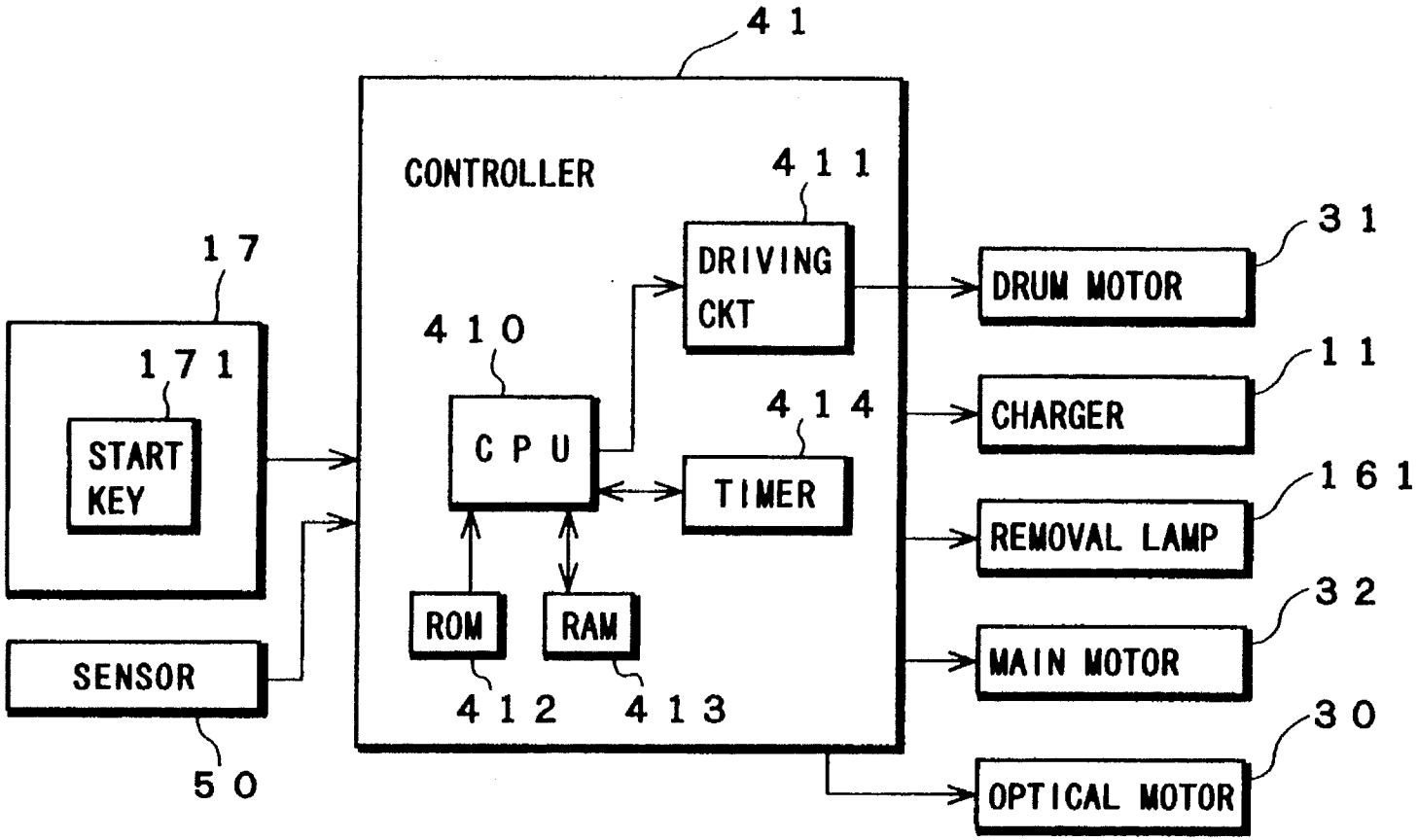
FIG. 2 is a block diagram showing a control system of the copying machine.

Next, a control system of the copying machine will be described with reference to FIG. 2. A controller 41 receives an instruction signal from the function key portion 17 and then generates a control signal to each portion of the copying machine, e.g., the optical assembly L, imaging assembly P, and sheet transport assembly.

Specifically, the controller 41 controls the entire operations of the copying machine, and includes a CPU (Central Processing Unit) 410, a driving circuit 411 for driving the photosensitive drum 10, a ROM (Read Only Memory) 412, a RAM (Random Access Memory) 413, and a timer 414.

The function key portion 17 includes function keys for selectively setting the number of copy sheets per one original image and the size of copy sheet and a start key 171 for instructing a start of the copying operation.

Upon the start key 171 being turned on, the CPU 410 starts the main charger 11, the charge removal lamp 161, the main motor 32, and the timer 414, and further sends a control signal to the driving circuit 411 to rotate the photosensitive drum 10 at the second speed S2.

Upon the timer 414 measuring up a predetermined time T after the photosensitive drum 10 and the main charger 11 being driven, the CPU 410 changes the rotation speed of the photosensitive drum 10 from the second speed S2 to the first speed S1 by the way of the driving circuit 411. Immediately after the photosensitive drum 10 is changed from the second speed S2 to the first speed S1, the optical system drive motor 30 is driven to start the image formation.

The driving circuit 411 is an electric circuit capable of outputting a pulse-width modulated signal. Upon receiving a control signal from the CPU 410, the driving circuit 411 modulates the pulse width of the output signal to change the speed of the photosensitive drum drive motor 31, thereby changing the rotation speed of the photosensitive drum 10.

The ROM 412 stores a program for controlling the operations of the copying machine. The RAM 413 stores the above-mentioned time T and instruction data set at the function key portion 17. It is to be noted that the predetermined time T is not less than a time which allows the photosensitive drum 10 to make one turn at the second speed S2.

Figure 3:
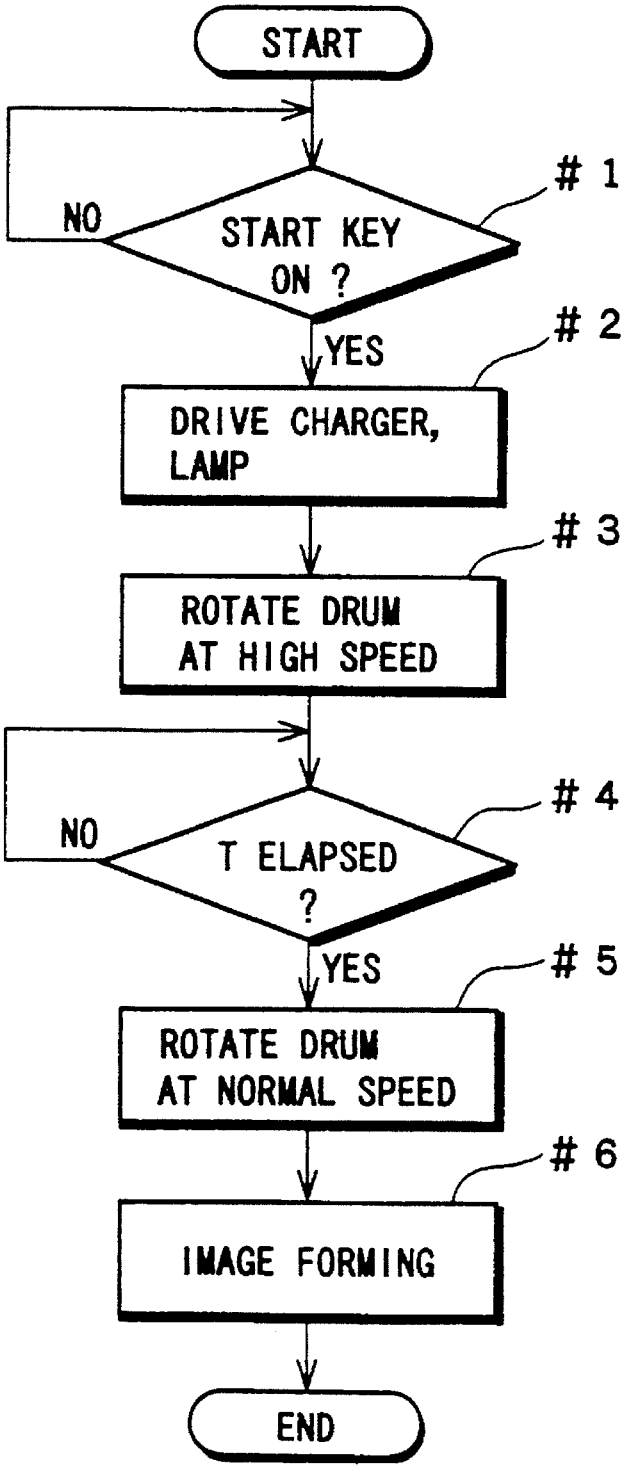
FIG. 3 is a flowchart showing an operation of the control system.

An operation of the copying machine will be described next with reference to FIGS. 3 and 4.

When the start key 171 is depressed after the number of copy sheets per one original image and the size of copy sheet being set at the function key portion 17 (YES in Step #1), the main charger 11, the charge removal lamp 161 and the main motor 32 are driven (Step #2). Simultaneously, as shown in FIG. 4, the photosensitive drum 10 is rotated at the second speed S2, i.e., high speed, by permitting the driving circuit 411 to send a wide width pulse signal to the photosensitive drum drive motor 31 (Step #3).

In Step #4, it is judged whether the timer 414 measures the predetermined time T after the start key 171 being depressed. When the predetermined time T elapses (YES in Step #4), the drive circuit 411 outputs a narrow width pulse signal to the drive motor 31 to rotate the photosensitive drum 10 at the first speed S1 slower than the second speed S2. i.e., normal speed (Step #5). In other words, the photosensitive drum 10 is rotated at the normal speed after the photosensitive drum 10 completes one turn and the entire photosensitive surface has been charged by the main charger 11 and removed by the removal lamp 161. The one-turned photosensitive drum 10 already has an increased dark potential on the entire surface. Accordingly, there is left no initial charging area.

After the photosensitive drum 10 completes the initial one turn, in other words, the initial charging area is eliminated, the image forming operation is started (Step #6). Specifically, a document placed on the contact glass 1 is illuminated by the exposure lamp 3 and a reflected light image is introduced by way of the reflecting mirrors 5, 6, and 7, the lens unit 8, and the fixed mirror 9 onto the secondly charged surface of the photosensitive drum 10 to form an electrostatic latent image. The latent image is developed into a toner image by the developing device 13.

On the other hand, a copy sheet is taken out of the cassette 18 or 19 by the feed roller 20 or 21, and transported into the image forming assembly P by the transport roller pairs 22, 23. The copy sheet is transported further near the surface of the photosensitive drum 10 by the registration roller pair 24 simultaneously when the latent image is developed into the toner image.

The toner image is transferred onto the copy sheet from the photosensitive drum 10 by the transferring device 14. The copy sheet bearing the toner image is separated from the surface of the photosensitive drum 10 by the separating device 15, and transported further downstream by the transport belt 26 up to the fixing device 27 where the toner image is fixed on the copy sheet, and then discharged to the tray 29 by the discharge roller pair 28.

Instead of detecting the completion of the initial turn of the photosensitive drum 10 with the use of the timer 414, also, it may be possible to attach a mark 51 at a specified position on a side of the photosensitive drum 10 and provide a sensor 50 for sensing the mark 51 to detect the initial turn of the photosensitive drum 10. In this case, the CPU 410 allows the photosensitive drum 10 to rotate at the second speed S2 until the sensor 50 senses the mark 51 and the CPU 410 judges the completion of the initial turn of the photosensitive drum 10 after the main charger 11 is turned on. After the completion of the initial turn being judged, the photosensitive drum 10 is rotated at first speed S1.

As described above, a first image formation is started in synchronism with the start of the second turn of the photosensitive drum 10, which prevents a potential difference for the image formation and then a tone difference in the copy image. Also, the photosensitive drum 10 is set at the second speed S2, i.e., high speed, for the predetermined time T which allows the photosensitive drum 10 to complete at least one turn from a stationary state. This will reduce or shorten the time for initial turn of the photosensitive drum 10. Accordingly, the high speed copy machine according to the present invention can produce a uniform tone copy image: 1) without the influence of the potential difference between an initial charging area and a second charging area; and 2) at a shortened time.

Figure 4:
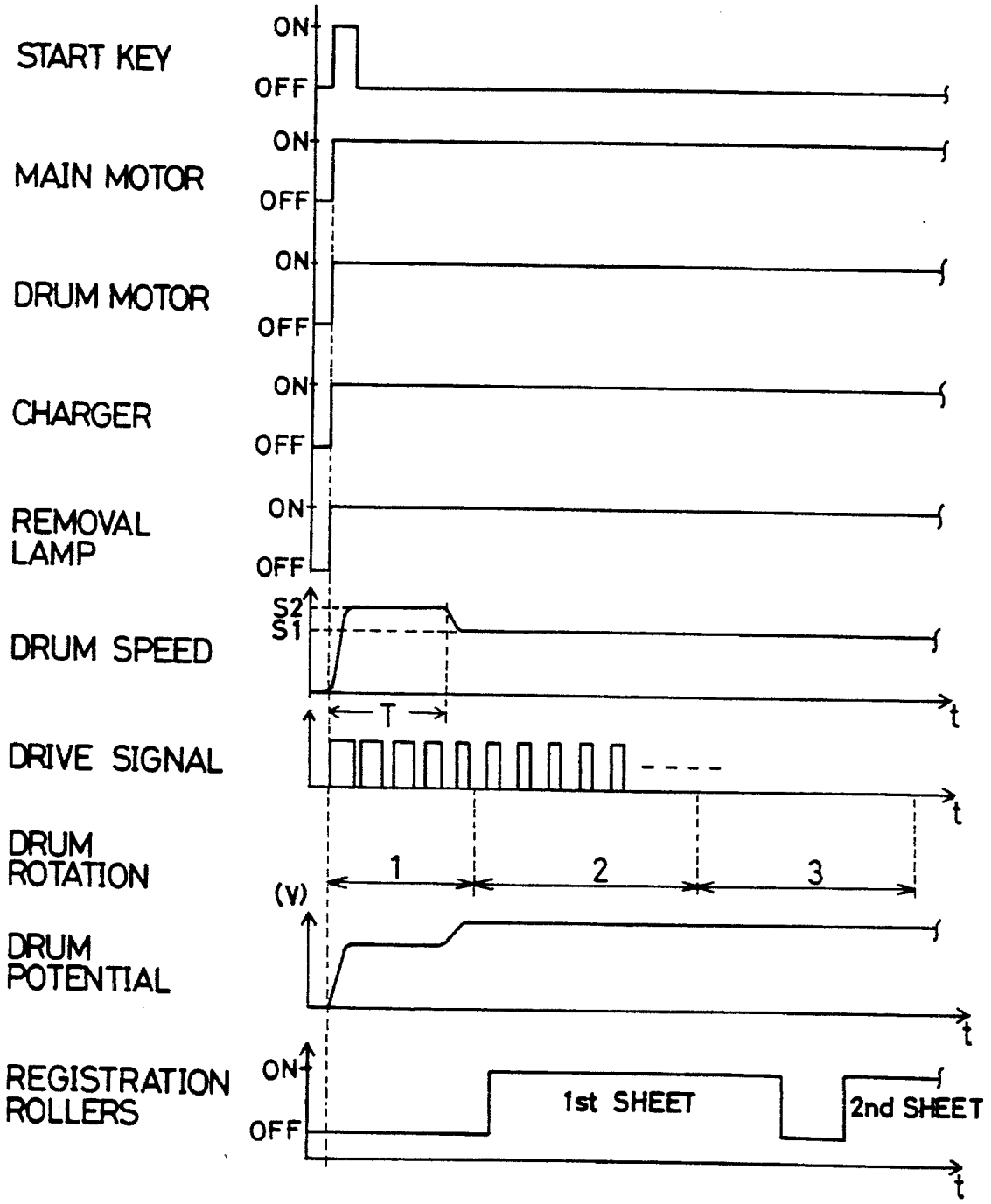
Figure 5:
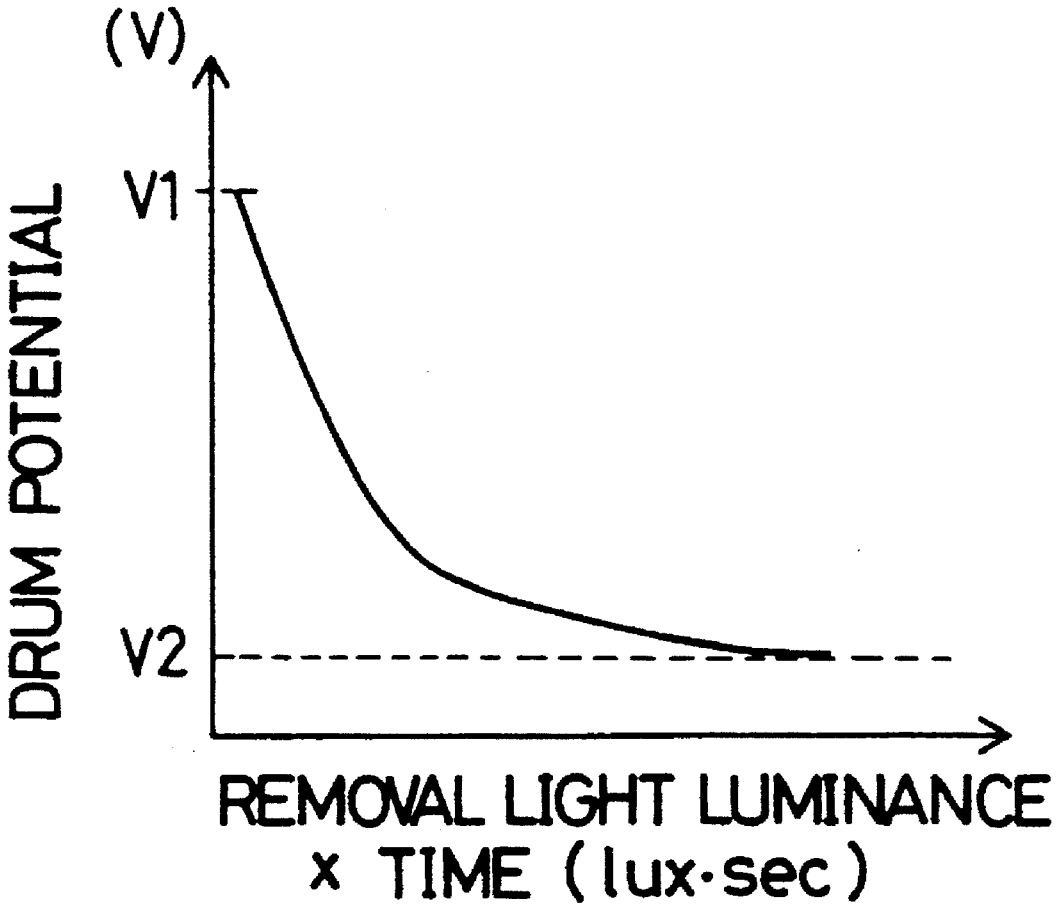
FIG. 5 is a graph showing a change in a surface potential of a photosensitive drum with respect to the luminance and illuminating time of a removal lamp.

In the foregoing embodiment, the surface potential of the photosensitive drum 10 at the initial turn is low because the photosensitive drum 10 is rotated at the higher speed S2 as shown in FIG. 4. To increase the initial surface potential, accordingly, it may be appreciated to increase the level of electric current flowing through the main charger 11 in the initial turn. However, a change in the initial surface potential will not greatly influence a change in the dark surface potential of the photosensitive drum 10 after being removed by the removal lamp 161. Accordingly, it may be possible not to increase the initial charging current as the foregoing embodiment.

What is claimed is:

1. An image forming apparatus comprising:

a photosensitive drum rotatable in a specified direction;

a photosensitive drum driver for rotating the photosensitive drum at either a first speed or a second speed faster than the first speed;

a charger for charging the photosensitive drum;

an image formation portion including:

a light image projector for projecting a light image onto a charged surface of the photosensitive drum to form an electrostatic latent image;

a developer for developing the electrostatic latent image into a toner image; and a transfer for transferring the toner image onto copy paper;

a charge remover, disposed downstream of the charger, for removing residual charges on the photosensitive drum surface after the toner image is transferred;

a starter for instructing a start of an image forming operation; and a controller responsive to the starter for, upon the starter being turned on, driving the charger and the charge remover to remove charges from the photosensitive drum charged by the charger, controlling the photosensitive drum driver to rotate the photosensitive drum at the second speed, and suspending the image formation portion; and after the photosensitive drum completes an initial one turn, driving the image formation portion together with the charger and the charge remover, and controlling the photosensitive drum driver to rotate the photosensitive drum at the first speed.

2. An image forming apparatus as defined in claim 1 wherein the controller includes detector means for detecting the completion of the initial turn of the photosensitive drum.

3. An image forming apparatus as defined in claim 2 wherein the detector means includes:

a memory for storing a time necessary for the photosensitive drum to make one turn at the second speed; and a timer for detecting the lapse of the time.

4. An image forming apparatus as defined in claim 2 wherein the detector means includes:

a mark attached at a specified position of the photosensitive drum; and a sensor for sensing the mark to detect one turn of the photosensitive drum.

5. An image forming apparatus comprising:

a photosensitive drum rotatable in a specified direction;

a photosensitive drum driver for rotating the photosensitive drum at either a first speed or a second speed faster than the first speed;

a charger for charging the photosensitive drum;

an image formation portion including:

a light image projector for projecting a light image onto a charged surface of the photosensitive drum to form an electrostatic latent image;

a developer for developing the electrostatic latent image into a toner image; and a transfer for transferring the toner image onto copy paper;

a charge remover for removing residual charges on the photosensitive drum surface after the toner image is transferred:

a starter for instructing a start of an image forming operation; and a controller responsive to the starter for, upon the starter being turned on, driving the charger and the charge remover, permitting the photosensitive drum driver to rotate the photosensitive drum at the second speed, and suspending the image formation portion; and after the photosensitive drum completing the initial one turn, driving the image formation portion together with the charger and the charge remover, and permitting the photosensitive drum driver to rotate the photosensitive drum at the first speed; and the photosensitive drum driver including:

a motor for driving the photosensitive drum; and a driving circuit in connection with the controller for sending a wide width pulse drive signal to the motor to rotate the photosensitive drum at the second speed or a narrow width pulse drive signal to the motor to rotate the photosensitive drum at the first speed.

6. An image forming apparatus as defined in claim 5 wherein the controller includes detector means for detecting the completion of the initial turn of the photosensitive drum.

7. An image forming apparatus as defined in claim 6 wherein the detector means includes:

a memory for storing a time necessary for the photosensitive drum to make one turn at the second speed; and a timer for detecting the lapse of the time.

8. An image forming apparatus as defined in claim 6 wherein the detector means includes:

a mark attached at a specified position of the photosensitive drum; and a sensor for sensing the mark to detect one turn of the photosensitive drum.

* * * * *